United States Patent [19]

Fritsch et al.

[11] Patent Number: 4,919,396

[45] Date of Patent: Apr. 24, 1990

[54] APPARATUS FOR SMELTING MELTABLE SUBSTANCES, PARTICULARLY ORE CONCENTRATES

[75] Inventors: Walter Fritsch, Bergisch Gladbach; Friedrich Megerle, Köln, both of Fed. Rep. of Germany

[73] Assignee: Klockner-Humboldt-Deutz Aktiengesellschaft, Fed. Rep. of Germany

[21] Appl. No.: 238,521

[22] Filed: Aug. 31, 1988

[30] Foreign Application Priority Data

Sep. 5, 1987 [DE] Fed. Rep. of Germany ..... 3729798

[51] Int. Cl.[5] ..... F27B 15/08

[52] U.S. Cl. ..... 266/182; 266/267; 266/172; 75/453

[58] Field of Search ..... 266/182, 221, 267, 171, 266/175, 186, 188; 75/26, 92

[56] References Cited

U.S. PATENT DOCUMENTS 4,414,022 11/1983 Melcher ..... 75/26

4,422,624 12/1983 Dunham ..... 266/182

FOREIGN PATENT DOCUMENTS 2132150 1/1973 Fed. Rep. of Germany ..... 75/38

2922189 10/1980 Fed. Rep. of Germany .

49-20696 5/1974 Japan ..... 266/182

401875 3/1974 U.S.S.R. ..... 266/182

*Primary Examiner*—Melvyn J. Andrews

*Attorney, Agent, or Firm*—Hill, Van Santen, Steasdman & Simpson

[57] ABSTRACT

An apparatus for smelting meltable substances, particularly ore concentrates. A transfer element joins the cyclone discharge to the furnace and is arranged between the melting cyclone and the furnace. In this way, the fitting, particularly the re-fitting of an open-hearth furnace with a melting cyclone can be significantly simplified; or, on the other hand, the melting cyclone can be very easily dismantled for the purpose of repair or can be replaced by another melting cyclone in a relatively short time, namely without a significant interruption of furnace operations.

9 Claims, 1 Drawing Sheet

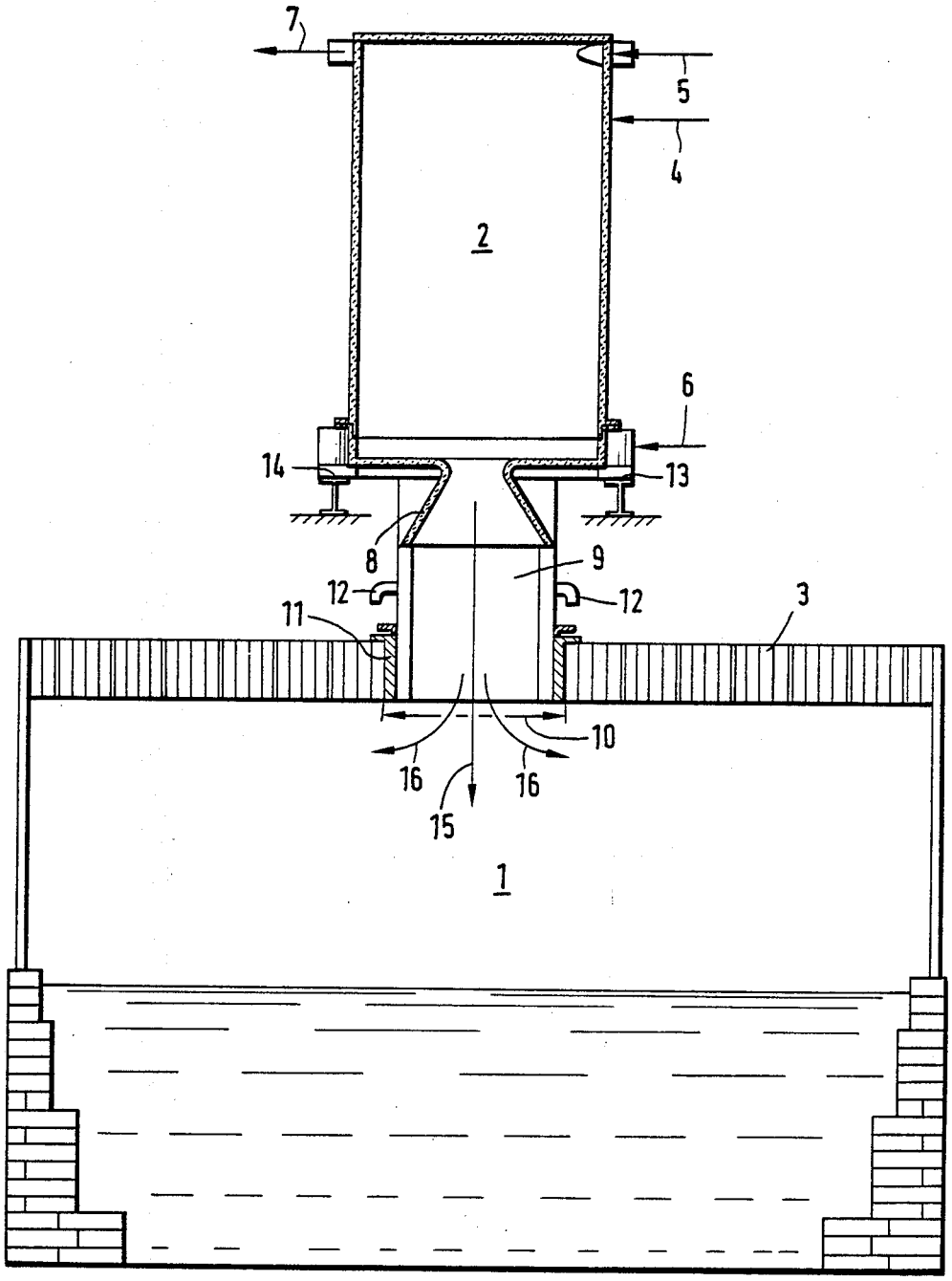
7
5
4
2
6
14
13
8
9
12
12
11
3
10
16
16
15
1

APPARATUS FOR SMELTING MELTABLE SUBSTANCES, PARTICULARLY ORE CONCENTRATES

BACKGROUND OF THE INVENTION

The invention relates to an apparatus for smelting meltable substances, particularly ore concentrates, and more particularly to a furnace having a melting cyclone that is arranged above the furnace.

German Patent 29 22 189 discloses an apparatus for smelting meltable substances such as ore concentrate that is composed of a furnace housing and of a melting cyclone whose discharge enters directly into the furnace from above. The melting cyclone, which is conically tapered in a downward direction, thereby forms a structural unit with the furnace. The ore concentrate is melted in fractions of seconds in the melting cyclone at high temperatures and proceeds from above into the furnace, where the melt is subjected to an after-treatment.

An object of the invention is to create an apparatus that significantly simplifies and facilitates the fitting, particulary re-fitting of a pyro-metallurgical furnace with a melting cyclone.

A further object of the invention is to provide an improved metallurgical furnace structure including a melting cyclone and a furnace wherein the structures are uniquely related to support and cooperate with each other for improved furnace operation.

A further object of the invention is to provide an improved metallurgical furnace structure with a melting cyclone wherein the units are constructed so as to facilitate separation and assembly without damage to the aligned furnace.

The objects are achieved in that a transfer element that connects the cyclone discharge to the furnace is installed between the melting cyclone and the furnace.

FEATURES OF THE INVENTION

As a result of the installation of a transfer element between the melting cyclone and the furnace, the melting cyclone can be very advantageously placed or mounted on existing open-hearth furnaces in a relatively simple way and without any significant interruption of operations. The particular advantage of the invention is that the required opening in the roof of the open-hearth furnace is small in relationship to the cyclone diameter.

According to a further, advantageous development of the invention, the transfer element is executed water-cooled, preferably as a double jacket or pipe structure. This water-cooled transfer element of the invention can be easily withdrawn from the opening of the furnace roof at any time as needed or it can be introduced into the opening from above without the furnace lining being damaged or destroyed.

A further advantageous development of the invention lies in the cylindrical shaping of the melting cyclone. Compared to the previously known, conical fashioning of the melting cyclone, a significantly better utilization of the space and thermal energy for the melting process in the cyclone is achieved by this cylndrical shaping of the melting cyclone.

In order to achieve a relaxation and abatement of the downwardly emerging gas stream from the melting cyclone, the cyclone discharge is advantageously widened funnel-like in a downward direction and centrally from the floor of the melting cyclone.

Other objects, features and advantages will become more apparent with the teaching of the principles of the invention in connection with the disclosure of the preferred embodiment thereof in the specification, claims and drawings, in which:

DESCRIPTION OF THE DRAWING

The single drawing labelled FIG. 1 is a somewhat schematic showing of a vertical section taken through a metallurgical furnace constructed and operating in accordance with the principles of the present invention.

DESCRIPTION OF THE PREFERRED EMBODIMENT

FIG. 1 shows an apparatus for smelting meltable substances, particularly ore concentrates, comprising a furnace 1, a bipartitely constructed melting cyclone 2 that is arranged at a distance above a roof 3 of the furnace 1, this roof 3 being constructed of refractory stone. A conduit shown schematically at 4 through which the ore concentrate is introduced into the melting cyclone 2 together with the additives discharges laterally into the melting cyclone 2. Conduits 5 through which fuel, and particularly technically pure oxygen, is insufflated tangentially into the melting cyclone 2 during operation of the melting cyclone 2 are also laterally connected to the melting cyclone.

The cooling of the jacket of the melting cyclone ensues via a coolant delivery conduit 6 laterally arranged at the melting cyclone 2 at the bottom and via a coolant outlet conduit 7 secured to the melting cyclone 2 at the top.

In accordance with the invention, a transfer element 9 is arranged between the cyclone discharge 8 and the furnace 1, this transfer element essentially comprising a pipe conduit provided with a cooling jacket or with cooling pipes that is conducted through the opening 10 in the roof 3 of the furnace 1. A sealing compound 11 constructed of refractory material is inserted between the transfer element 9 and the roof 3 of the furnace 1. The sealing compound 11 not only effects a gas-tight closure between the transfer element 9 and the furnace lining but prevents the lining of the roof 3 of the furnace 1 from being damaged or destroyed when the transfer element 9 is introduced into the opening 10 in the furnace roof 3 or when this tranfer element 9 is removed from the roof 3. For mounting or dismantling the transfer element 9, it is outwardly provided with hook-shaped projections 12. The melting cyclone 2 which, for the purpose of a better use of space and thermal energy, is cylindrically shaped and rests on carriers 13 and 14, and the lower cyclone part is an integrated component part of the transfer element. The funnel-shaped widening of the cyclone discharge 8 in a downward direction serves for an abatement of the gas stream that proceeds into the furnace through the transfer element 9 together with the melt (arrow 15). The gas stream is laterally eliminated from the furnace in arrow direction 16 immediately after entering into the furnace 1.

This arrangement wherein the transfer of materials from the cyclone to the furnace is accomplished, provides for a discharge venturi 8 which has an opening of restricted or limited size at the base of the cyclone but which widens in a divergent circular passage in a downward direction thereby reducing the speed of flow of the materials. The materials then flow through the water cooled conduit 9 and are dispersed as indicated by the arrowed lines 15 and 16 as they enter the furnace thereby accomplishing a unique intermixing or diffusion into the furnace chamber below thhe furnace roof.

The transfer element 9 is arranged between the melting cyclone 2 and the furnace 1 and the upper part of the melting cyclone can be lifted off outwardly in an easy manner at any time, whether for purposes of repair or whether for purposes of replacement, and the opening of the transfer element can be closed with a cover without interruption of the furnace operations. The transfer element 9 can always remain in the roof 3 of the furnace 1 during mounting or dismantling of the upper part of the melting cyclone and need not be removed. The furnace roof 3 is protected in this region against overloads or damage to its lining.

The apparatus of the invention also enables the fitting or re-fitting of existing open-hearth furnaces with a melting cyclone in order to achieve a significant increase in the furnace throughput performance. The attachment of a transfer element in the roof of the open-hearth furnace to be refitted and the placement of the upper part of the melting cyclone onto the transfer element can thereby also be undertaken in an easy manner during furnace operations.

We claim as our invention:

1. An apparatuus for smelting meltable substances comprising in combination:

a furnace;

a melting cyclone arranged above said furnace out of which a melted mass is discharged into the furance via a discharge opening in the bottom of the cyclone and an opening in the roof of the furnace;

and a transfer element including a vertical pipe connecting the discharge opening of the cyclone discharge to the opening in the roof of the furnace.

2. An apparatus for smelting meltable substances constructed according to claim 1:

wherein said transfer element is comprised of a conduit provided with a cooling jacket with the conduit extending through said opening in the roof of the furnace.

3. An apparatus for smelting meltable substances constructed according to claim 1:

wherein said melting cyclone and said transfer element are circular in horizontal cross-section.

4. An apparatus for smelting meltable substances constructed according to claim 1:

wherein the cyclone discharge opening has a venturi which flares outwardly in a widened funnel-like shape in a downward direction.

5. An apparatus for smelting meltable substances comprising in combination:

a melting cyclone for preliminary preparation of ore concentrates;

means for delivering a fuel with oxygen into the cyclone;

means for cooling an outer surface of the melting cyclone;

means defining a discharge opening at the base of the cyclone having a restricted size;

a venturi at the opening having a wall diverging outwardly downwardly from the opening in the base of the cyclone;

a transfer conduit extending downwardly from the discharge opening;

a furnace positioned beneath the cyclone having a roof;

and means defining a roof opening in the furnace roof receiving the transfer conduit whereby the material being discharged from the cyclone passes through the transfer conduit into the furnace diffusing as it enters the furnace.

6. An apparatus for smelting meltable substances constructed in accordance with claim 5: and including a water cooling jacket surrounding the conduit.

7. An apparatus for smelting meltable substances constructed in accordance with claim 5:

and including a cooling means at a base of the cyclone.

8. An apparatus for smelting meltable substances constructed in accordance with claim 5:

and including a yieldable sealing collar surrounding the conduit forming a seal between the furnace roof and the conduit whereby the conduit can be moved relative to the roof without damage thereto.

9. An apparatus for smelting meltable substances constructed in accordance with claim 5:

wherein said conduit rests vertically on the roof of said furnace.

* * * * *